United States Patent [19]

Wexler

[11] Patent Number: 4,738,450

[45] Date of Patent: Apr. 19, 1988

[54] SOFT PLAY BALL

[76] Inventor: Howard Wexler, 300 E. 40th St., New York, N.Y. 10016

[21] Appl. No.: 909,862

[22] Filed: Sep. 22, 1986

[51] Int. Cl.[4] ..... A63B 37/02; A63B 37/12

[52] U.S. Cl. ..... 273/58 A; 273/60 B; 273/65 R; 273/DIG. 20

[58] Field of Search ..... 273/415, 58 A, 60 B, 273/DIG. 20, DIG. 8, 199 R, 65 E, 65 ED, 65 EE

[56] References Cited

U.S. PATENT DOCUMENTS

| | | | |
|---|---|---|---|
| 187,848 | 2/1877 | Hale | 273/60 A |
| 646,350 | 3/1900 | Breinl | 273/58 A |
| 1,262,532 | 4/1918 | McElroy | 273/58 A |
| 1,754,937 | 4/1930 | Comstock | 273/DIG. 20 |
| 1,861,157 | 5/1932 | Grady | 273/60 A |
| 2,743,931 | 5/1956 | Pooley et al. | 273/199 R |
| 2,753,599 | 7/1956 | Pietraszek et al. | 273/60 B X |
| 2,938,237 | 5/1960 | Kern et al. | 273/60 B |
| 3,185,476 | 5/1965 | Fechner | 273/DIG. 20 X |
| 3,354,578 | 11/1967 | Ryan | 273/DIG. 8 X |
| 3,518,786 | 7/1970 | Holtvoigt | 273/DIG. 20 X |
| 4,011,611 | 3/1977 | Lederman | 273/415 X |
| 4,065,126 | 12/1977 | Mantz | 273/58 A |
| 4,131,276 | 12/1978 | Judkins | 273/DIG. 8 X |
| 4,150,826 | 4/1979 | Baldorossi et al. | 273/DIG. 20 X |
| 4,151,994 | 5/1979 | Stalberger | 273/58 A |
| 4,241,918 | 12/1980 | Massino | 273/58 A X |
| 4,261,565 | 4/1981 | Massino | 273/DIG. 20 X |
| 4,337,944 | 7/1982 | Massino | 273/DIG. 20 X |
| 4,462,589 | 7/1984 | Morgan | 273/DIG. 8 X |
| 4,463,951 | 8/1984 | Kumasaka et al. | 273/58 A |
| 4,598,909 | 7/1986 | Ventura et al. | 273/DIG. 8 X |

*Primary Examiner*—George J. Marlo

*Attorney, Agent, or Firm*—Michael Ebert

[57] ABSTRACT

A soft and lightweight play ball for use by pre-school and small children, the ball having the configuration and external appearance of a relatively hard and heavy conventional athletic ball of a given type, such as a football or baseball. The play ball is effectively "dead" and almost free of bounce, hence it rebounds only slightly when striking a hard surface; and the ball is highly compressible, thereby making it possible for a small child to grasp, throw and catch the ball without difficulty. The play ball is constituted by a smooth, somewhat elastomeric casing including a polyvinyl plastic outer skin laminated to a stretchable inner reinforcing liner, whose shape and external appearance are similar to those of a conventional athletic ball, the squeezable casing enveloping a compressible core formed of shreds of soft, fibrous material, whereby the fingers of the child grasping the ball press therein to provide a good grip despite the smoothness of the casing.

2 Claims, 2 Drawing Sheets

Fig. 1.
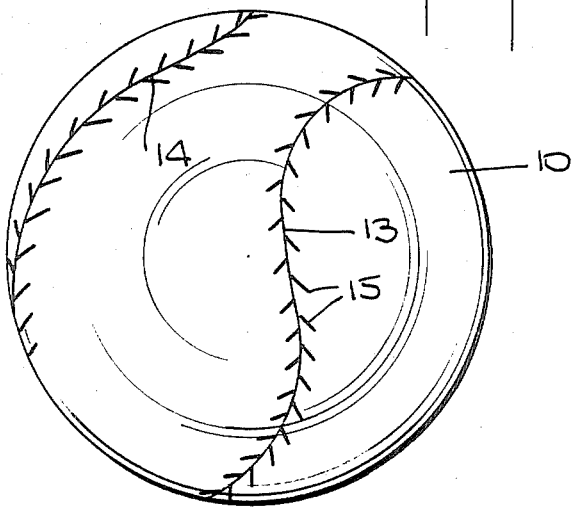
Fig. 3.
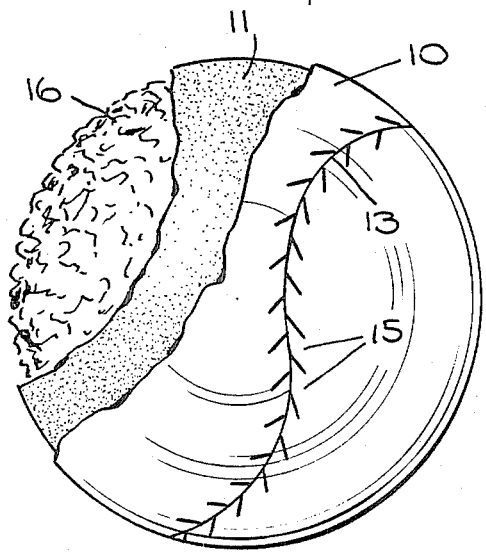
Fig. 4.
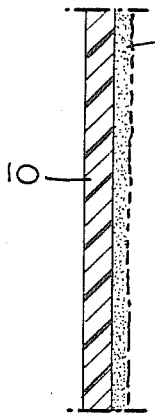
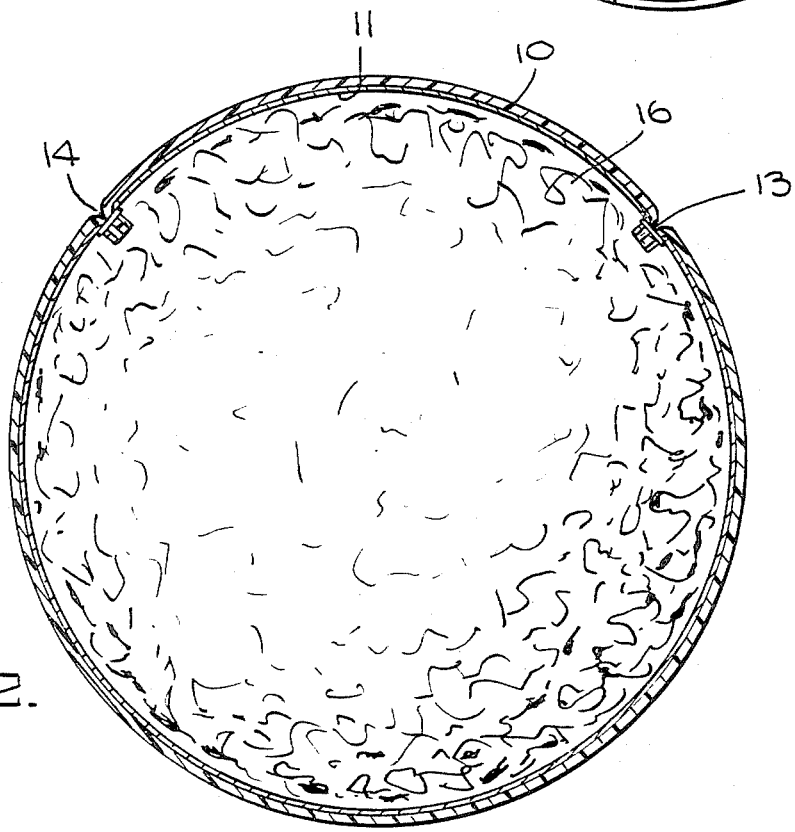
Fig. 2.

Fig. 5.
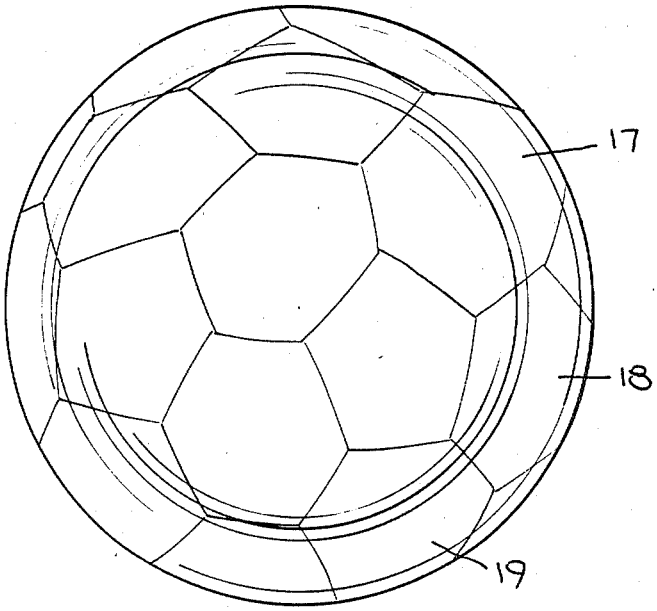
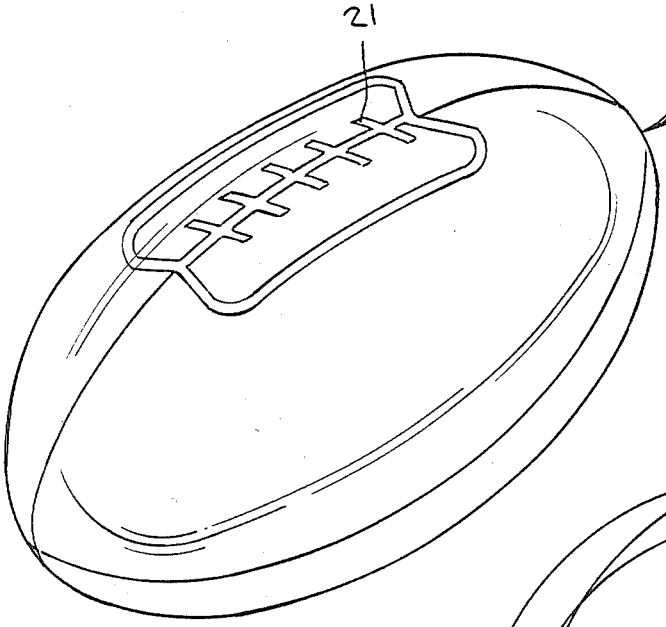
Fig. 6.
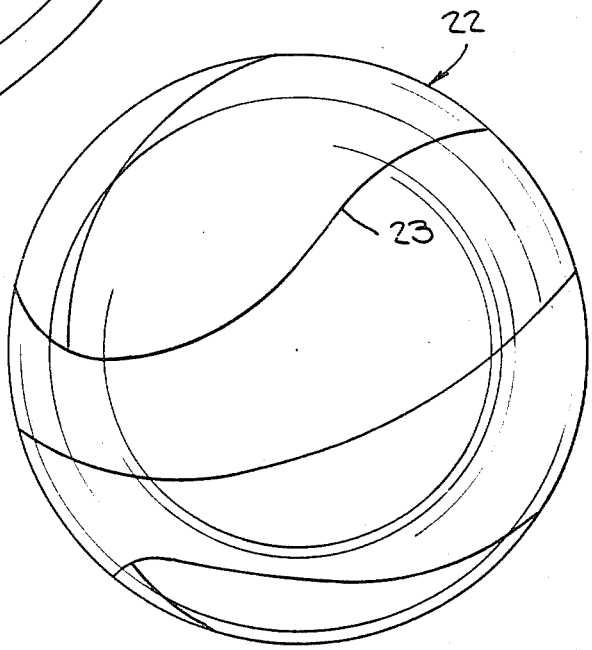
Fig. 7.

SOFT PLAY BALL

BACKGROUND OF INVENTION

1. Field of Invention

The present invention relates generally to play balls for use by pre-school and very young children who are incapable of handling conventional athletic balls, and more particularly to a play ball whose shape and external appearance are similar to those of a conventional athletic ball but whose physical characteristics are such as to render the ball safe and usable by a small child.

2. Status of Prior Art

Athletic playing balls fall into two distinct classes, one of which covers balls of the air-inflated type such as footballs, soccer balls, volley balls and basketballs. The second class encompasses balls having solid cores such as baseballs and hardballs. But regardless of its class, a conventional athletic ball is not suitable or safe for pre-school and very young children, particularly for indoor play.

Thus, a conventional inflated soccer ball has physical characteristics appropriate to a game in which the ball is to be kicked or thrown by the player and must have a high degree of bounce so that it can rebound from the ground or from the head of a player. A standard inflated soccer ball has a spherical shape and is provided with an outer cover of thick, heavy leather or plastic material. While an adult may not regard a soccer ball as being heavy, it represents a substantial load to a small child.

It is known that air-inflated athletic balls such as volleyballs and basketballs tend to produce a "hand sting" which arises when the ball which has a relatively hard casing is caught by a bare hand while moving at high velocity, or is struck by the hand of the player as when playing volleyball. To overcome this drawback, the Barton et al. U.S. Pat. No. 3,256,019 incorporates cushioning in the outer casing of the inflated ball. But such cushioning does not reduce the weight of the ball or alter its basic physical characteristics.

While small children are attracted to conventional athletic balls and enjoy watching adults play soccer, football and other ball games, in the hands of a small child these athletic balls are heavy and dangerous, especially in indoor play.

The standard inflated athletic ball has a relatively large diameter and a smooth, hard outer casing which makes it very difficult for a small child to grasp, throw and catch. And because a standard ball is highly bounceable, should the child play with the ball at home or in an indoor playground, the bouncing ball is likely to break windows and cause a great deal of damage to any fragile object.

The toy and game industry has long recognized the need for a lighter, softer and potentially less dangerous ball for young children. Thus, balls in various shapes and sizes are now commercially available which are molded of polyurethane foam material and other lightweight compressible plastics. While such balls are safe in the hands of pre-school children and will inflict no harm even if the ball is hurled toward the body of another child, they fail in many respects to satisfy the typical child's desire for a ball that looks like a real athletic ball of the type used by adults, and is not an unconvincing substitute therefor.

To give a simple analogy, children enjoy playing with toy guns whose form and general appearance simulate those used in actual combat. But if a child were given a stick and told to pretend that this was a gun, he would not enjoy playing cops and robbers. By the same token, a small child who would like to play with a baseball wishes to have a ball that at least looks like a baseball, even if the ball is very soft and lacks those physical properties of a standard baseball which render the ball hazardous to children.

In an attempt to satisfy this requirement, the Massino U.S. Pat. No. 4,241,918 discloses a ball having the general appearance of a conventional football, but is softer and lighter and does not travel as far when thrown or kicked by young children who are susceptible to injury with a conventional football. The ball is composed of an inner core formed of polyester batting fill, a wool batting interior cover and a double knit fabric outer cover. Hence in the Massino patent, the casing is of fabric construction and does not have the feel or appearance of the leather or smooth plastic casing found in standard play balls.

SUMMARY OF INVENTION

In view of the foregoing, the main object of this invention is to provide a soft play ball for pre-school and very young children whose configuration and external appearance are similar to those of a conventional athletic ball of a given type such as a basketball or baseball, but whose physical characteristics are such as to render the play ball safe and usable by a child.

More particularly, an object of this invention is to provide a ball of the above type which is lightweight, and effectively "dead;" that is, the ball is almost free of bounce and therefore only rebounds slightly when striking a hard surface.

Also an object of the invention is to provide a ball that is highly compressible, thereby making it possible for a small child to grasp, throw and catch the ball without difficulty.

Among the advantages of a ball in accordance with the invention are the following:

1. The play ball looks like a standard athletic ball of a given type and thereby satisfies the child's requirement in this regard, yet is relatively lightweight so that the child has no difficulty in handling it.

2. Because the play ball is very soft and compressible, the child can grasp the ball with his fingers which press into and temporarily indent the ball to give him a firm grip thereon despite its smooth surface, making it easy for the child to manipulate the ball.

3. Because the soft ball is effectively "dead," it will not rebound to any significant degree from a floor or other hard surface and possibly do damage to fragile articles in the play room or wherever else the child plays with the ball. Also, if the child player hurls the ball at another child, it will in no way injure that child.

Yet another object of this invention is to provide a soft ball which is inexpensive to manufacture and mass produce.

Briefly stated, these objects are attained in a soft and lightweight play ball for use by pre-school and small children, the ball having the configuration and external appearance of a relatively hard and heavy conventional athletic ball of a given type, such as a football or baseball. The play ball is effectively "dead" and almost free of bounce, hence it rebounds only slightly when striking a hard surface; and the ball is highly compressible, thereby making it possible for a small child to grasp, throw and catch the ball without difficulty. The play ball is constituted by a smooth, somewhat elastomeric casing whose shape and external appearance are similar to those of a conventional athletic ball, the squeezable casing enveloping a compressible core formed of soft, shredded material, whereby the fingers of the child grasping the ball press therein to provide a good grip despite the smoothness of the casing.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a play ball in accordance with the invention that looks like a conventional athletic baseball but has different physical characteristics;

FIG. 2 is a diametrical section taken through the play ball;

FIG. 3 is a partially cut away view of the play ball;

FIG. 4 is a section taken through the casing of the ball;

FIG. 5 is a perspective view of a play ball that looks like a conventional athletic soccer ball;

FIG. 6 is a perspective view of a play ball that looks like a conventional athletic football; and FIG. 7 is a perspective view of a play ball that looks like a conventional athletic basketball.

DESCRIPTION OF INVENTION

Referring now to FIGS. 1 to 4, there is illustrated a play ball in accordance with the invention that has the spherical configuration and external appearance of a conventional athletic baseball.

The play ball includes a spherical casing constituted by an outer skin 10, and a reinforcing inner liner 11 laminated thereto. Outer skin 10 is formed of contour cut interfitting pieces of somewhat elastomeric plastic film material having a thickness of a few mils, such as polyvinyl chloride or polyethylene. These pieces are sewn together by filamentary stitching thread lines 13 and 14. Use is made of natural or synthetic threads for this purpose, such as cotton or nylon. Radiating from these stitching lines are printed lines 15 which in practice may be silk-screened on the plastic skin so that the play ball has the appearance of a standard baseball in all respects.

The inner liner 11 laminated to the thin outer skin 10 serves to reinforce this skin and is preferably formed of a thin layer of stretchable foam plastic material, such as polyurethane foam. Alternatively, use may be made of a stretchable fabric scrim for the same purpose.

The ball casing envelops a core 16 formed of shredded flexible foam plastic material or shredded polyester, cotton or other fibrous batting material, so that the core is highly compressible. The density of the core is relatively low so that the play ball, though it is not air filled, will float on water and not sink.

Because the ball is highly compressible, the fingers of a small child grasping the ball will press into and temporarily indent the ball and will give him a good grip thereon despite the fact that the outer surface of the ball is relatively smooth. This physical characteristic of the play ball makes it easy for the pre-school player to grasp, throw and catch the ball.

The structure of the play ball is such that it is effectively "dead" and almost free of bounce. Thus, a play ball of the type shown in FIG. 1 in a free fall from a height of 10 feet onto a hard surface will bounce only a few inches and therefore has a very low coefficient of bounce. This physical characteristic renders the ball safe in the hands of small children, for its slight bounce will prevent damage to objects in the vicinity of the ball when it strikes a hard surface. And if the hard surface struck by the ball is a window or other fragile surface, it will not break the window, for the velocity of the ball when thrown by a small child is relatively low. And if the play ball is hurled by the child player at another child, it is no more dangerous than a hurled pillow, for the play ball is relatively lightweight, soft and compressible.

The embodiment of the play ball shown in FIG. 5 has the shape and external appearance of a soccer ball. In this instance, the outer skin of the casing is formed by pentagonshaped stretchable plastic pieces 17, 18, 19, etc., which are sewn together. Some of these pieces are dyed black, the others being white, as in a standard athletic soccer ball. However, the diameter of the play soccer ball is not as great as a standard athletic soccer ball, so that it can be handled more easily by a small child.

In the embodiment of the play ball 20 shown in FIG. 6, its shape and appearance are those of a conventional athletic football, but its dimensions are somewhat smaller so that it can be manipulated more readily by a small child. This play ball is provided with stitching 21 in a pattern resembling the lacing found in a conventional football, so that this ball looks like a real football.

And in the embodiment of the play ball 22 shown in FIG. 7, the spherical ball resembles a conventional athletic basketball but is of smaller size to render it suitable for manipulation by a small child. The ball includes stitching lines 23 as in a conventional basketball. In the balls shown in FIGS. 5, 6 and 7, the casing and the core have the same structure as the play ball shown in FIG. 1 and has the same physical characteristics which render the ball safe in the hands of a small child.

The play balls illustrated in the drawing are by way of example only, and in practice a play ball in accordance with the invention may be made in any desired shape and given any desired appearance to resemble an actual athletic play ball of a particular type.

While there has been shown and described a preferred embodiment of a soft play ball in accordance with the invention, it will be appreciated that many changes and modifications may be made therein without, however, departing from the essential spirit thereof.

I claim:

1. A soft, highly compressible, lightweight throwable play ball, such as a baseball, a football or a soccer ball, that is safe and usable by a small, relatively weak child, said ball comprising:

A a casing provided with an elastomeric and smooth plastic outer skin and a stretchable inner reinforcing liner laminated to said skin, the casing being formed of contoured pieces which are stitched together, the degree to which the casing is elastomeric being such that when the casing is subjected to finger pressure by said child it will then indent and thereby cup the finger, said casing having a shape and external appearance comparable to those of relatively hard and heavy conventional athletic ball of a given type; and B a core enveloped by the casing and fully occupying the casing formed primarily of shreds of soft and highly compressible fibrous material to impart physical characteristics to the play ball such that the fingers of said child grasping the casing will press into and temporarily indent the casing and compress the core to give the child a good grip thereon despite the smoothness of the casing, and the ball is effectively "dead" and therefore rebounds only to a slight degree if at all, when striking a hard surface whereby the ball is effectively bounceless, said core having a relatively low density so that the ball will float on water even though it is not air-inflated.

2. A ball as set forth in claim 1, wherein said skin is formed of stretchable polyvinyl plastic film material.

* * * * *